United States Patent [19]

Benjamin, Jr. et al.

[11] 4,388,919

[45] Jun. 21, 1983

[54] RAPID STABILIZATION OF EXTERNAL CARDIAC PULSATION

[75] Inventors: Joel M. Benjamin, Jr., Hoffman Estates, Ill.; Victor Meyer, Jr., Telford, Pa.

[73] Assignee: Intermedics Cardiassist Corporation, Freeport, Tex.

[21] Appl. No.: 207,692

[22] Filed: Nov. 17, 1980

[51] Int. Cl.[3] ..... A61H 7/00

[52] U.S. Cl. ..... 128/64; 128/24 R

[58] Field of Search ..... 128/64, 65, 66, 38, 128/10, 24 R, 206 R, 419 D, 334, 672, 1 D

[56] References Cited

U.S. PATENT DOCUMENTS

| | | | |
|---|---|---|---|
| 3,288,132 | 11/1966 | Meredith | 128/64 |
| 3,303,841 | 2/1967 | Dennis | 128/24 R |
| 3,403,673 | 10/1968 | MacLeod | 128/64 |
| 3,452,739 | 7/1969 | Guarino | 128/1 D |
| 3,654,919 | 4/1972 | Birtwell | 128/64 |
| 3,734,087 | 5/1973 | Sauer et al. | 128/64 |
| 3,835,845 | 9/1974 | Maher | 128/672 |
| 3,866,604 | 2/1975 | Curless | 128/64 |
| 3,878,839 | 4/1975 | Norton | 128/64 |
| 3,885,554 | 5/1975 | Rockwell | 128/64 |
| 4,016,871 | 4/1977 | Schiff | 128/64 |

*Primary Examiner*—Richard J. Apley
*Assistant Examiner*—David J. Brown
*Attorney, Agent, or Firm*—Andrew F. Kehoe

[57] ABSTRACT

Described below are an apparatus and process for starting up externally-applied, cardiac-assist processes of the type wherein the assist is synchronized with the heartbeat. The improved process comprises the controlled stepwise reduction in the time portion of the pressure cycle wherein pressure rises on a portion of the patient's body and also comprises the controlled stepwise increase in the time at which the higher pressure portion of the cycle is active on the patient's body.

6 Claims, 1 Drawing Figure

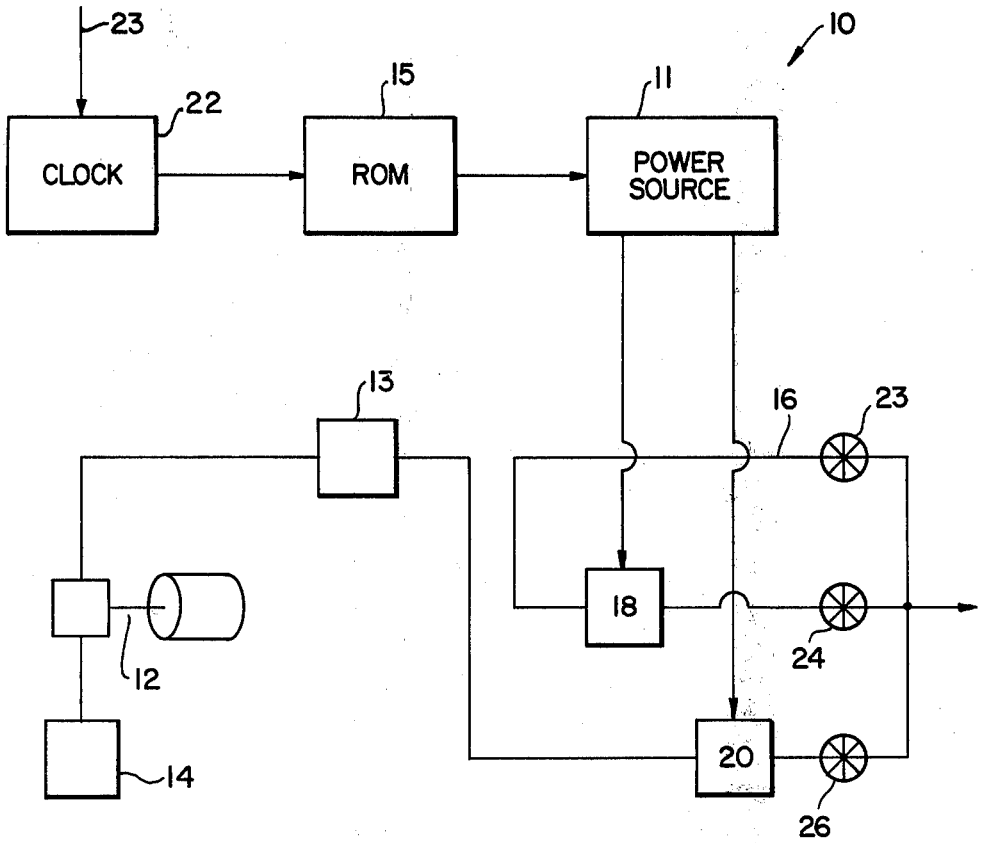
23
22
CLOCK
15
ROM
11
POWER SOURCE
10
13
16
23
18
24
12
14
20
26

RAPID STABILIZATION OF EXTERNAL CARDIAC PULSATION

BACKGROUND OF THE INVENTION

This invention relates to an improved process for applying external cardiac pulsation (ECP) to the body of an animal.

Among prior patents describing ECP processes are U.S. Pat. Nos. 3,303,841; 3,734,087; 3,835,845 and 3,654,919.

Those processes of particular interest are those which describe the careful control of the ECP cycle in synchronization with the heartbeat of a subject being treated.

SUMMARY OF THE INVENTION

The present inventors have realized that the apparatus of the prior art, when started up in a normal manner, startles or worries a patient. Such a response has been found to be undesirable even though its primary effect is psychological. Such psychological effects can and do manifest themselves in physical responses to the central nervous system such as, for example, the release of adrenalin. Such responses, it was deduced, even when not manifested by the person's outward behavior, were causing transient physical states in patients which, in turn, were delaying substantially establishment of the most effective therapeutic cycle for the patient under treatment. In such circumstances, it was not unusual for the patient to be "under treatment" for hundreds of heartbeats before the properly adjusted cycle could be stabilized. In some cases, this delay will represent a substantial additional risk to the patient. In all cases, such delay required substantially more attention to the machine by the operator during the adjustment period.

It has now been discovered that this adjustment time can be rapidly reduced, brought down to, say, 10–100 and preferably 15 to 50 heartbeats and very advantageously to about 20 heartbeats by phasing in the severity of external pulsation. In general, the approach can be viewed as reducing the area under the pressure pulse curve. Advantageously, the rate of rise in pressure during the assist pulse is initially low and increased stepwise during start-up. In a particularly advantageous mode of such a "phasing in" approach, the rise time of the pressure cycle is at first quite long and thereafter is shortened. Conversely, the time of the higher-pressure portion of a pulsation cycle is lengthened as the rise time decreases. It has been found that this procedure is of value even with many patients who in no outward way have expressed their concern or worry with the initial impact of the ECP apparatus on their persons.

It has been found that modification of the maximum pressure parameter and the rate of fall of the pressure parameters can also be utilized to reduce the initial psychic stress on the subject being treated. Thus, the initial pressure cycle can be modified by other means to ameliorate the physical impact of the initial cycles, i.e. by combining a reduction in the magnitude or rate of one or both of these parameters with the one or both of the pressure-rise rate and the high-pressure-term parameters.

ILLUSTRATIVE EMBODIMENT OF THE INVENTION

In this application there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modifiy it and embody it in a variety of forms, each as may be best suited in the condition of a particular case.

The drawing is a schematic diagram illustrative of one mode of implementing the invention.

Referring to FIG. 1, it is seen that a control mechanism 10 is illustrated for carrying out process of the invention with simplicity. The mechanism comprises a means to modify the flow of hydraulic fluid from reservoir 14 to the pulse-causing mechanism such as a piston, mechanically-actuated platen, or other such device which either pulses against a fluid bag around a patient's legs, or to a similar mechanical device pushing on the fluid itself.

For example, in terms of U.S. Pat. No. 3,835,845 the hydraulic fluid from the control mechanism of the present invention would be that applied to the hydraulic cylinder 78 of FIG. 1 of that Patent. This cylinder which serves as the device, the movement of which generally determines the shape of the pressure pulse in terms of its period, rate of rise and fall, etc.

FIG. 1 comprises a pump means 12 which supplies hydraulic fluid to three flow conduits and valves 18 and 20 and thence to a mechanical pulsing device which, in turn, will apply pressure to a mechanical pulsing means such as that shown as "platen 30" in U.S. Pat. No. 3,835,845. The first conduit 16 is normally open with its flow being restricted only by a preset needle valve 23. Flow control means 10 comprises a preset timing means, clock 22 and a programmed ROM, i.e. a read-only memory 16. The clock receives a pulse signal from the arterial pressure of the patient as indicated schematically at 25. These provide means to activate a timed electrical signal to a valve-controlling power source 11 which, in a pre-determined sequence, allows valves 18 and 20 to open fully at say times indicative of 10 and 20 heartbeats. The volume of flow which comes through each of valves 18 and 20 on their being opened is determined by the setting of needle valves 24 and 26 respectively. This setting is normally done at time of manufacture and is not part of the start-up procedure defined herein.

With opening of valve 18 and 20, the total amount of hydraulic fluid being supplied serially through conduit 16 and the conduits comprising valves 18 and 20 to the pulsating process is increased substantially, thereby gradually increasing the rate of pressure rise and gradually increasing the effective time of the relatively flat high pressure segment of the circulation-assisting pressure pulse. In a typical example, the volume flow of liquid through needle valves 23, 24 and 26 will increase in a ratio of 30:60:100.

It is to be noted that a flow valve 13 (which is the functional equivalent of servo valve 94 in U.S. Pat. No. 3,835,845) is still the prime flow determinant in terms of timimg of pulses according to the procedures already known to the art.

It will be apparent to those skilled in the art that various changes and further modifications of the invention may be made therein without departure from the spirit of the invention or from the scope of the appended claims.

What is claimed is:

1. In a process of applying external cardiac pulsation by applying pressure pulses to the limbs of a subject in synchronization with the subject's heartbeat and wherein said pressure pulses are characterized by a cycle comprising relatively rapid pressure-rise time and a relatively long peak pressure period before a drop in the pressure at the end of each said pulse, the improvement comprising initiating said process by adjusting the synchronization of the pressure of said pressure pulses with the heartbeat of the subject over a relatively short period of time by increasing stepwise, over a period of up to about 100 heartbeats, the rate of change of the pressure during pressure-rise or pressure-drop period and gradually increasing the time of said peak pressure period.

2. A process as defined in claim 1 wherein said relatively short period of time is over about 15 to about 30 heartbeats of said patient.

3. A process as defined in claim 1 or 2 wherein said rate of change of pressure during pressure-rise is gradually increased and said peak pressure of said pressure pulses are also gradually increased during said relatively short period of time.

4. In apparatus for applying external cardiac assist by applying pressure pulses to limbs of a subject in synchronization with the subject's heartbeat and wherein pressure time profile of said pressure pulses are characterized by a relatively rapid rise time, a relatively long peak pressure period before a drop in the pressure at the end of each said pulse, said apparatus comprising a fluid-chamber forming means to intimately contact said limbs, and transmit pressure pulses thereto, a mechanical means to transmit pressure pulses to said fluid-chamber, and hydraulic fluid means to generate pulses and transmit them to said mechanical means, the improvment comprising predetermined control means to modify the pressure-time profile of pulses generated by said hydraulic fluid over an initiation period such that the rate of pressure change during said pulses is gradually increased and said long peak pressure period is only reached toward the end of said initiation period.

5. Apparatus as defined in claim 4 wherein said control means comprises means to cause a predetermined stepwise increase in the flow of said hydraulic fluid during said 10 to 100 heartbeat time period.

6. Apparatus as defined in claim 4 wherein said control means comprises means to achieve at least three steps in hydraulic flow rating during about a 15 to 50 heartbeat time period.

* * * * *